US007927152B2

(12) United States Patent
Pepe et al.

(10) Patent No.: US 7,927,152 B2
(45) Date of Patent: Apr. 19, 2011

(54) ELECTRICAL CONNECTOR WITH CONTACT SPACING MEMBER

(75) Inventors: Paul John Pepe, Clemmons, NC (US); Sheldon Easton Muir, Whitsett, NC (US); Steven Richard Bopp, Jamestown, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/396,211

(22) Filed: Mar. 2, 2009

(65) Prior Publication Data

US 2010/0221956 A1 Sep. 2, 2010

(51) Int. Cl.
*H01R 24/00* (2006.01)

(52) U.S. Cl. ..... 439/676; 439/941

(58) Field of Classification Search ..... 439/76.1, 439/404, 676, 941

See application file for complete search history.

(56) References Cited

U.S. PATENT DOCUMENTS

| | | | | |
|---|---|---|---|---|
| 4,806,117 | A | 2/1989 | Johnston | |
| 5,178,563 | A | 1/1993 | Reed | |
| 5,186,647 | A | 2/1993 | Denkmann et al. | |
| 5,362,257 | A | 11/1994 | Neal et al. | |
| 5,587,884 | A | 12/1996 | Raman | |
| 5,915,989 | A | 6/1999 | Adriaenssens et al. | |
| 6,217,352 | B1 | 4/2001 | Oliphant et al. | |
| 6,769,936 | B2 | 8/2004 | Gutierrez et al. | |
| 7,533,196 | B2 * | 5/2009 | Tojima et al. | 710/22 |
| 7,568,938 | B2 * | 8/2009 | Siev et al. | 439/404 |
| 7,618,296 | B2 * | 11/2009 | Caveney | 439/676 |
| 2008/0064266 | A1 | 3/2008 | Givens et al. | |
| 2010/0041274 | A1 * | 2/2010 | Marti et al. | 439/607.01 |

FOREIGN PATENT DOCUMENTS

| | | | |
|---|---|---|---|
| EP | 1 858 125 | A1 | 11/2007 |
| WO | WO 2005/101579 | A1 | 10/2005 |

OTHER PUBLICATIONS

European Search Report, European Application No. EP 10 15 4994, European Filing Date Jan. 3, 2010.

* cited by examiner

*Primary Examiner* — Khiem Nguyen

(57) ABSTRACT

A contact sub-assembly is provided for an electrical connector. The contact sub-assembly includes a base and an array of contacts held by the base. Each contact extends along a length from a terminating end portion to a tip end portion. The tip end portion includes a tip surface. Each contact has a mating interface located along the length of the contact between the terminating end portion and the tip end portion. The contact sub-assembly also includes a spacing member formed separately from the base. The spacing member engages each of the contacts such that each contact is positioned relative to each adjacent contact in the array. At least a portion of the spacing member engaging each contact at a location along the length of the contact that is between the mating interface and the tip surface.

21 Claims, 7 Drawing Sheets

ELECTRICAL CONNECTOR WITH CONTACT SPACING MEMBER

BACKGROUND OF THE INVENTION

The subject matter described and/or illustrated herein relates generally to electrical connectors, and, more particularly, to electrical connectors that include contact arrays.

Electrical connectors that are commonly used in telecommunication systems provide an interface between successive runs of cables and/or between cables and electronic devices of the system. Some of such electrical connectors, for example modular jacks, are configured to be joined with a mating plug and include a contact sub-assembly having an array of mating contacts. Each of the mating contacts of the contact sub-assembly includes a mating interface that engages a corresponding contact of the mating plug at a mating end portion of the contact sub-assembly. The contact sub-assembly may also include a plurality of wire terminating contacts at a wire terminating end portion of the contact sub-assembly. The wire terminating contacts may be electrically connected to the mating contacts via a circuit board.

The mating contacts are typically held by a base of the contact sub-assembly. The base holds the mating interfaces of the mating contacts in a predetermined arrangement in which each of the mating interfaces is positioned to engage the corresponding contact of the mating plug. Specifically, the base holds the mating contacts such that the mating interfaces of adjacent mating contacts have a predetermined spacing therebetween, sometimes referred to as pitch. The pitch between the mating contacts locates each of the mating interfaces for engagement with the corresponding contact of the mating plug. The predetermined arrangement of the mating interfaces may be, for example, a known industry standard such as International Electrotechnical Commission (IEC) 60603-7.

The spacing methods and structures of at least some known contact sub-assemblies may be more difficult and/or expensive to manufacture and/or assemble than may be desired. For example, the base of at least some known contact sub-assemblies includes a plurality of slots at the mating end portion of the contact sub-assembly. The slots are spaced apart from each other according to the predetermined pitch between the mating contacts. Each slot holds the end portion of one of the mating contacts therein such that the mating interfaces of the mating contacts are spaced apart by the predetermined pitch. In addition or alternative, the base of at least some known contact sub-assemblies may also include a plurality slots adjacent the wire terminating end portion of the contact sub-assembly for attaining the predetermined pitch between the mating contacts. However, such slots within the base may increase the difficulty and/or cost of manufacturing the base and/or the contact sub-assembly. Moreover, such slots within the base may make it more difficult to mount the mating contacts on the base, which may increase the difficulty and/or cost of assembling the contact sub-assembly.

BRIEF DESCRIPTION OF THE INVENTION

In one embodiment, a contact sub-assembly is provided for an electrical connector. The contact sub-assembly includes a base and an array of contacts held by the base. Each contact extends along a length from a terminating end portion to a tip end portion. The tip end portion includes a tip surface. Each contact has a mating interface located along the length of the contact between the terminating end portion and the tip end portion. The contact sub-assembly also includes a spacing member formed separately from the base. The spacing member engages each of the contacts such that each contact is positioned relative to each adjacent contact in the array. At least a portion of the spacing member engages each contact at a location along the length of the contact that is between the mating interface and the tip surface.

Optionally, the spacing member covers a portion of each of the contacts. Each contact is optionally held by the spacing member. In some embodiments, the spacing member is molded over a portion of at least one of the contacts. Each contact may include an outer surface extending along the length from the terminating end portion to the tip end portion. The spacing member optionally covers an approximate entirety of the outer surface of each of the contacts along a portion of the length thereof. In some embodiments, the spacing member includes an opening extending through the spacing member, wherein one of the contacts extends through the opening. Optionally, the spacing member extends along the length of each contact approximately entirely between the mating interface and the tip surface. The spacing member optionally includes two body portions formed separately or one integrally formed body portion separated into two body portions.

The spacing member may be a first spacing member and the contact sub-assembly optionally includes a second spacing member formed separately from the base. Optionally, at least a portion of the second spacing member engages each contact at a location along the length of the contact that is between the mating interface and a terminating surface of the terminating end portion. The second spacing member optionally includes a latch feature that cooperates with a latch member of the base to connect the second spacing member to the base. Each contact may have an intermediate portion extending from the terminating end portion to the mating interface. Optionally, at least a portion of the second spacing member engages each contact along the intermediate portion.

In another embodiment, an electrical connector includes a housing and a contact sub-assembly held by the housing. The contact sub-assembly includes a base and an array of contacts held by the base. Each contact extends along a length from a terminating end portion to a tip end portion. The tip end portion includes a tip surface. Each contact has a mating interface located along the length of the contact between the terminating end portion and the tip end portion. The contact sub-assembly also includes a spacing member formed separately from the base. The spacing member engages each of the contacts such that each contact is positioned relative to each adjacent contact in the array. At least a portion of the spacing member engages each contact at a location along the length of the contact that is between the mating interface and the tip surface.

In another embodiment, a contact sub-assembly is provided for an electrical connector. The contact sub-assembly includes a base and an array of contacts held by the base. Each contact extends along a length from a terminating end portion to a tip end portion. The tip end portion includes a tip surface. Each contact has a mating interface located along the length of the contact between the terminating end portion and the tip end portion. The contact sub-assembly also includes a spacing member molded over a portion of at least one of the contacts. The spacing member engages each of the contacts such that each contact is positioned relative to each adjacent contact in the array. At least a portion of the spacing member engages each contact at a location along the length of the contact that is between the mating interface and the tip surface.

DETAILED DESCRIPTION OF THE INVENTION

Figure 1:
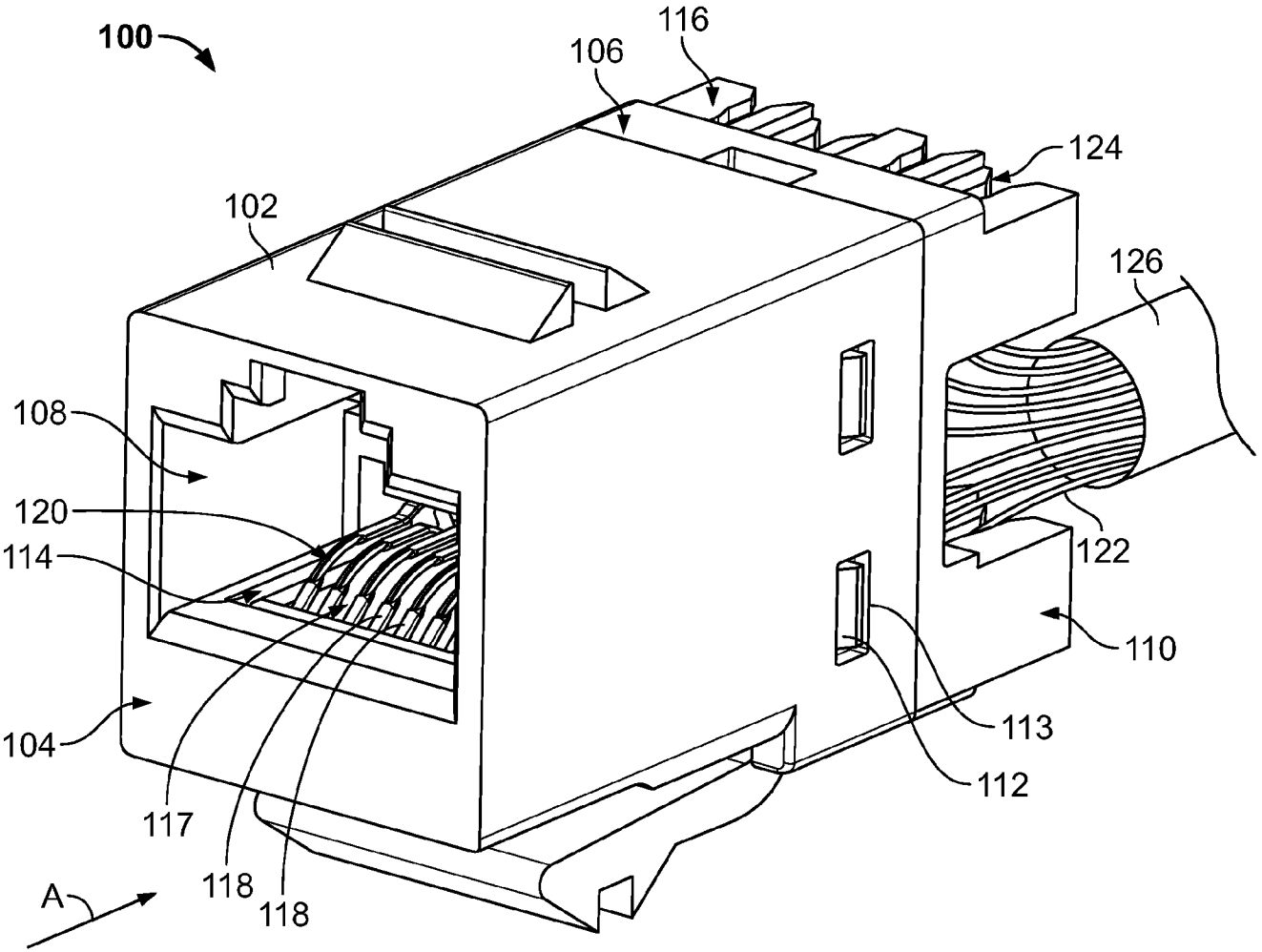
FIG. 1 is perspective view of an exemplary embodiment of an electrical connector.

FIG. 1 is perspective view of an exemplary embodiment of an electrical connector 100. In the exemplary embodiment, the connector 100 is a modular connector, such as, but not limited to, an RJ-45 outlet or jack. The connector 100 is configured for joining with a mating plug (not shown). The mating plug is loaded along a mating direction, shown generally by arrow A. The connector 100 includes a housing 102 extending from a mating end portion 104 to a terminating end portion 106. A cavity 108 extends between the mating end portion 104 and the terminating end portion 106. The cavity 108 receives the mating plug through the mating end portion 104.

The connector 100 includes a contact sub-assembly 110 received within the housing 102 through the terminating end portion 106 of the housing 102. In the exemplary embodiment, the contact sub-assembly 110 is secured to the housing 102 via tabs 112 that cooperate with corresponding openings 113 within the housing 102. The contact sub-assembly 110 extends from a mating end portion 114 to a terminating end portion 116. The contact sub-assembly 110 is held within the housing 102 such that the mating end portion 114 of the contact sub-assembly 110 is positioned proximate the mating end portion 104 of the housing 102. The terminating end portion 116 extends outward from the terminating end portion 106 of the housing 102. The contact sub-assembly 110 includes an array 117 of a plurality of contacts 118. Each contact 118 within the array 117 includes a mating interface 120 arranged within the cavity 108. Each mating interface 120 engages a corresponding contact (not shown) of the mating plug when the mating plug is mated with the connector 100. The arrangement of the contacts 118 may be controlled by industry standards, such as, but not limited to, IEC 60603-7. In an exemplary embodiment, the connector 100 includes eight contacts 118 arranged as differential pairs. However, the connector 100 may include any number of contacts 118, whether or not the contacts 118 are arranged in differential pairs.

In the exemplary embodiment, a plurality of communication wires 122 are attached to terminating portions 124 of the contact sub-assembly 110. The terminating portions 124 are located at the terminating end portion 116 of the contact sub-assembly 110. Each terminating portion 124 is electrically connected to a corresponding one of the contacts 118. The wires 122 extend from a cable 126 and are terminated to the terminating portions 124. Optionally, the terminating portions 124 include insulation displacement connections (IDCs) for terminating the wires 122 to the contact sub-assembly 110. Alternatively, the wires 122 may be terminated to the contact sub-assembly 110 via a soldered connection, a crimped connection, and/or the like. In the exemplary embodiment, eight wires 122 arranged as differential pairs are terminated to the connector 100. However, any number of wires 122 may be terminated to the connector 100, whether or not the wires 122 are arranged in differential pairs. Each wire 122 is electrically connected to a corresponding one of the contacts 118, as will be described below. Accordingly, the connector 100 provides electrical signal, electrical ground, and/or electrical power paths between the mating plug and the wires 122 via the contacts 118 and the terminating portions 124.

Figure 2:
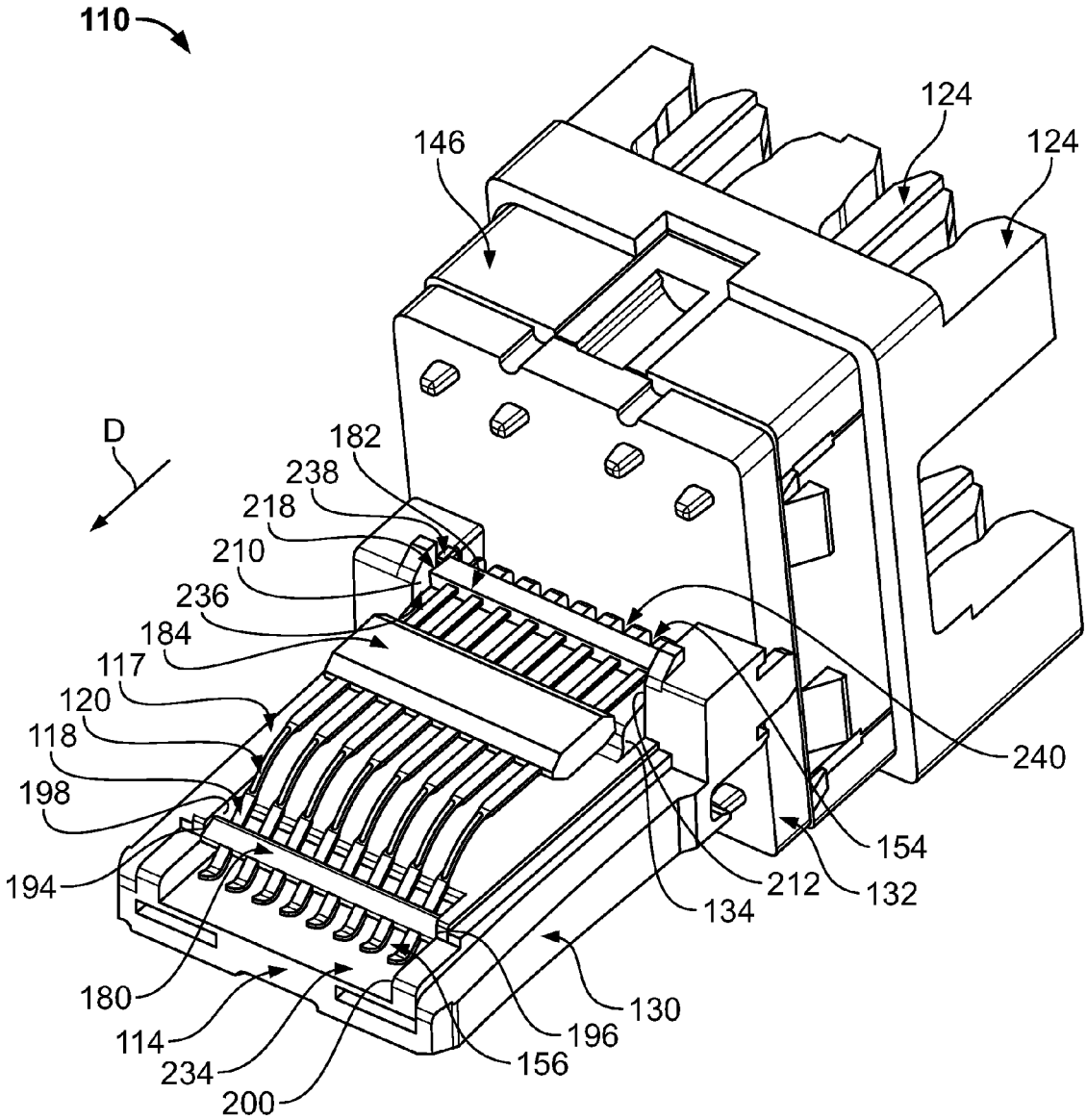
FIG. 2 is a perspective view of an exemplary embodiment of a contact sub-assembly of the electrical connector shown in FIG. 1.

FIG. 2 is a perspective view of an exemplary embodiment of the contact sub-assembly 110. The contact sub-assembly 110 includes a base 130 extending from the mating end portion 114 to an optional circuit board 132. The base 130 holds the contact array 117 such that the contacts 118 extend in a direction that is generally parallel to the loading direction (shown in FIG. 1 by arrow A) of the mating plug (not shown). Optionally, the base 130 includes a supporting block 134 positioned proximate to the circuit board 132. The contact sub-assembly 110 includes a terminating portion body 146 extending from the circuit board 132. The terminating portion body 146 includes the terminating portions 124. The terminating portion body 146 is sized to substantially fill the rear portion of the housing cavity 108 (FIG. 1). Optionally, each terminating portion 124 is electrically connected to a corresponding contact 118 via the circuit board 132.

Figure 3:
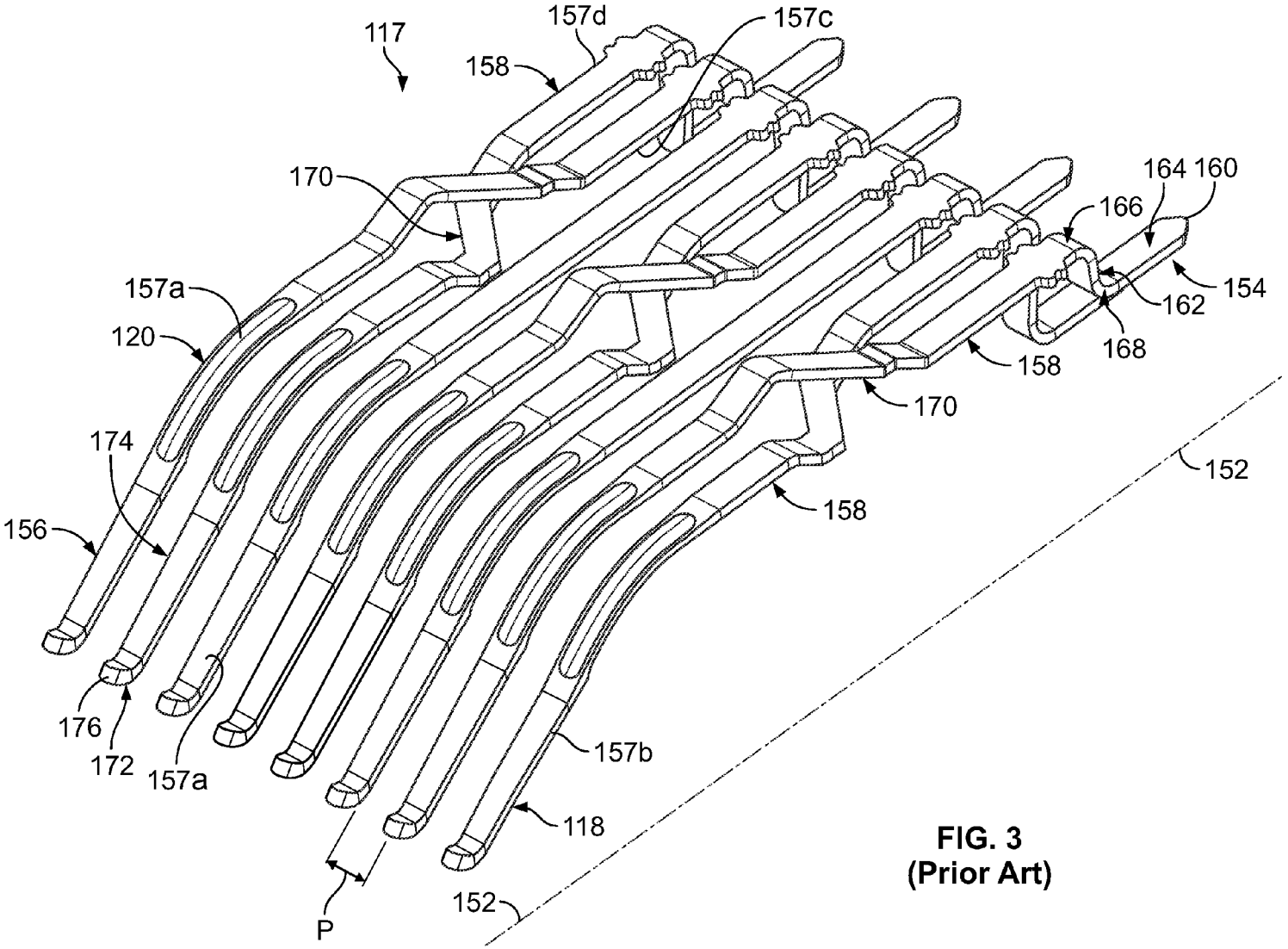
FIG. 3 (Prior Art)
FIG. 3 is a perspective view of an exemplary embodiment of an array of contacts of the contact sub-assembly shown in FIG. 2.

FIG. 3 is a perspective view of an exemplary embodiment of the contact array 117. In the exemplary embodiment, the contact array 117 includes eight contacts 118 arranged as differential contact pairs. However, the contact array 117 may include any number of contacts 118, whether or not the contacts 118 are arranged in differential pairs. Moreover, the configuration, arrangement, relative positions, relative locations, geometry, shape, size, and/or the like of the contacts 118 that is described and/or illustrated herein is meant as exemplary only. The contacts 118 may have other configurations, arrangements, relative positions, relative locations, geometries, shapes, sizes, and/or the like than is shown and/or described herein.

Each contact 118 extends a length along a contact axis 152 from a terminating end portion 154 to a tip end portion 156. An intermediate portion 158 extends between the terminating end portion 154 and the tip end portion 156 of each contact 118. As described above, each contact 118 includes the mating interface 120, which extends between the intermediate portion 158 and the tip end portion 156. Specifically, the intermediate portion 158 extends from the terminating end portion 154 to the mating interface 120, and the mating interface 120 extends from the intermediate portion 158 to the tip end portion 156. Each contact 118 includes an outer surface 157 that extends along the length of the contact 118 from the terminating end portion 154 to the tip end portion 156. In the exemplary embodiment, the outer surface 157 includes four sides 157*a*, 157*b*, 157*c*, and 157*d* such that each contact 118 includes an approximately rectangular cross-sectional shape. However, the outer surface 157 of each contact 118 may include any number of sides and each contact 118 may have any cross-sectional shape.

The terminating end portion 154 of each contact 118 terminates to the circuit board 132 (FIG. 2). Alternatively, the terminating end portion 154 of one or more of the contacts 118 is directly terminated to a corresponding one of the wires 122 (FIG. 1). The terminating end portion 154 of each contact 118 includes an outermost terminating surface 160. Optionally, a portion of the terminating end portion 154 may extend non-parallel to the contact axis 152 to change the elevation of the contact 118 with respect to the base 130 (FIGS. 1, 2, and 7) of the contact sub-assembly 110 (FIGS. 1 and 2). In the exemplary embodiment, the terminating end portion 154 of each of the contacts 118 includes a pair of legs 162 and 164. The leg 162 extends from the intermediate portion 158 at a bend 166 and extends approximately perpendicular to contact axis 152. The leg 164 extends from the leg 162 at a bend 168 and extends approximately parallel to the contact axis 152. Alternatively, one or more of the legs 162 may extend at any other angle relative to the contact axis 152 than approximately perpendicular, such as, but not limited to, an oblique angle or approximately parallel relative to the contact axis 152. Moreover, one or more of the legs 164 may extend at any other angle relative to the contact axis 152 than approximately parallel, such as, but not limited to, an oblique angle or approximately perpendicular relative to the contact axis 152. In some alternative embodiments, the terminating end portion 154 of one or more of the contacts 118 includes a single leg that extends from the intermediate portion 158 approximately parallel to the contact axis 152. For example, in some alternative embodiments, the terminating end portion 154 of one or more of the contacts 118 does not include the bends 166 and 168. Moreover, in some alternative embodiments, the terminating end portion 154 of one or more of the contacts 118 includes a single leg that extends from the intermediate portion 158 approximately perpendicular to the contact axis 152. For example, in some alternative embodiments, the terminating end portion 154 of one or more of the contacts 118 does not include the bend 168.

In the exemplary embodiment, the legs 162 of the terminating end portions 154 of adjacent contacts 118 have different lengths such that the legs 164 of adjacent contacts 118 are aligned for engagement with the circuit board 132 in a non-planar arrangement. Alternatively, each of the legs 164 of the terminating end portions 154 of the contacts 118 are aligned for engagement with the circuit board 132 in an approximately planar arrangement.

The intermediate portion 158 of each contact 118 extends from the terminating end portion 154 to the mating interface 120. Optionally, the intermediate portion 158 of one or more of the contacts 118 includes a cross-over section 170 that crosses over or under the intermediate portion 158 of an adjacent contact 118. In the exemplary embodiment, six of the eight contacts 118 within the contact array 117 include a cross-over section 170. However, any number of the contacts 118 within the contact array 117 may include a cross-over section 170.

As described above, the mating interface 120 of each contact 118 extends from the intermediate portion 158 to the tip end portion 156. In the exemplary embodiment, the mating interface 120 is a curved portion. However, the mating interface 120 may have any size, shape, geometry, and/or the like. The mating interfaces 120 are positioned to engage the mating plug (not shown) when the mating plug is mated with the electrical connector 100 (FIG. 1). Specifically, a portion of the outer surface side 157*a* that extends along the mating interface 120 engages a corresponding contact (not shown) of the mating plug. As can be seen in FIG. 3, each contact 118, and more specifically the mating interface 120 of each contact 118, is spaced apart from each adjacent contact by a predetermined pitch P.

The tip end portion 156 of each contact 118 includes a tip 172 and a leg 174. The leg extends from the mating interface 120 to the tip 172. The tip 172 extends outwardly from the leg 174 to an outermost tip surface 176. Optionally, the leg 174 of each contact 118 is angled relative to the intermediate portion 158, as can be seen in FIG. 3. In the exemplary embodiment, the tips 172 of each of the contacts 118 are aligned along a single plane. Alternatively, the tips 172 may be arranged on multiple planes.

Figure 4:
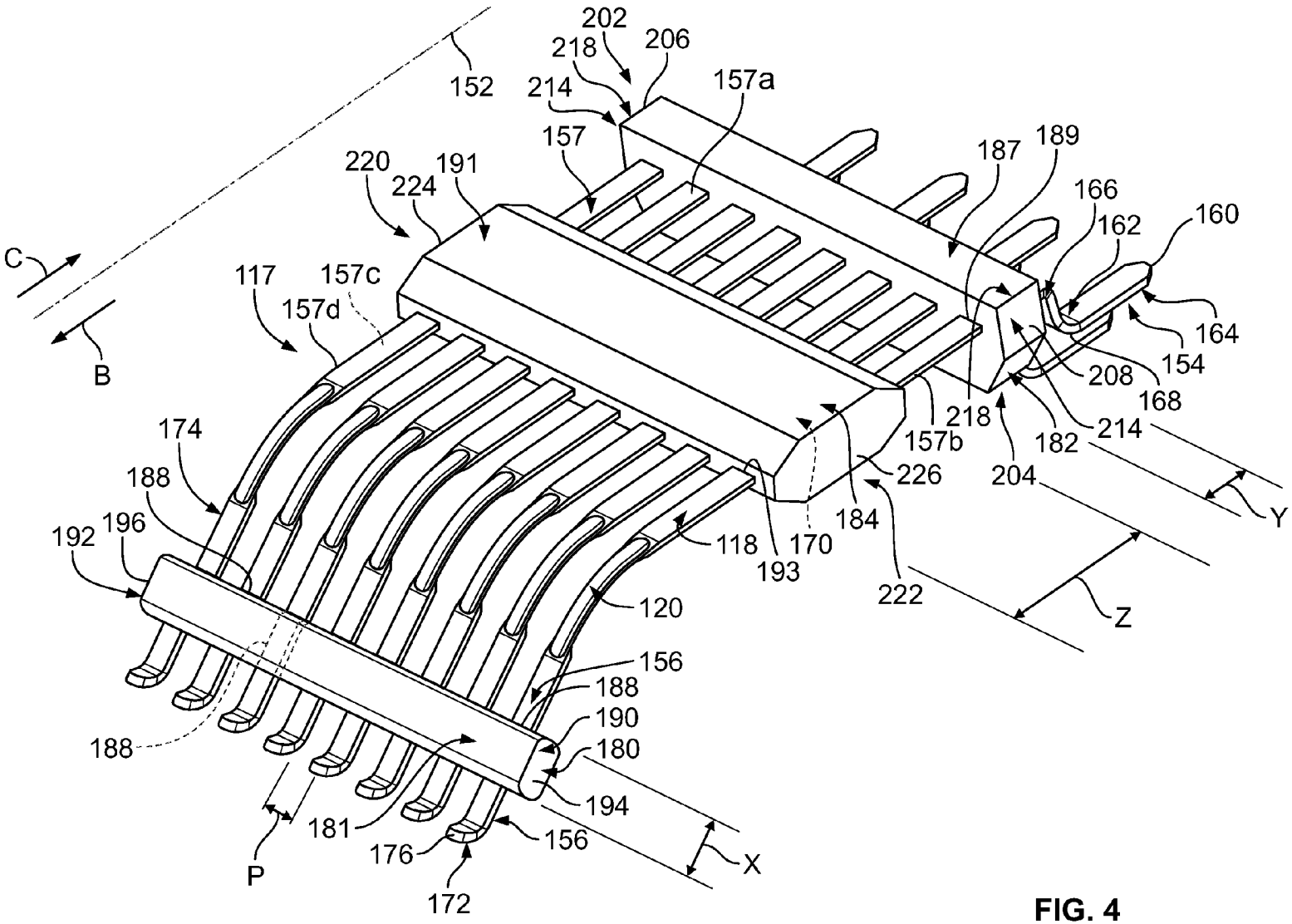
FIG. 4 is a perspective view of the contact array shown in FIG. 3 having exemplary embodiments of a plurality of spacing members engaged therewith.

FIG. 4 is a perspective view of the contact array 117 having exemplary embodiments of a plurality of spacing members 180, 182, and 184 engaged therewith. The spacing member 180 positions each contact 118 relative to each adjacent contact 118. For example, the spacing member 180 facilitates spacing the mating interfaces 120 of the contacts 118 apart from each other by the predetermined pitch P. The spacing member 180 also facilitates preventing adjacent contacts 118 from engaging and thereby electrically shorting. The spacing member 180 may also facilitate orienting and/or aligning the contact array 117 with the base 130 (FIGS. 1, 2, and 7), as will be described below. The spacing member 180 may be referred to herein as a "first spacing member".

The spacing member 180 includes a body 181 that spaces apart the contacts 118 via engagement with each contact 118. In the exemplary embodiment, the spacing member body 181 covers and engages an approximate entirety of a circumference of the outer surface 157 of each contact 118 (along a portion X of the length of the contact 118). Specifically, the spacing member body 181 includes a plurality of openings 188. Each contact 118 extends through a corresponding one of the openings 188. The surface(s) of the spacing member body 181 defining each opening 188 covers and engages an approximate entirety of the circumference of the outer surface 157 of the corresponding contact 118. Accordingly, in the exemplary embodiment, each contact 118 is held by the spacing member 180. Alternatively, the spacing member body 181 only covers and/or engages a portion of the circumference of the outer surface 157 of one or more of the contacts 118. For example, the spacing member body 181 may only cover and/or engage a portion or all of only some of the side surfaces 157*a*, 157*b*, 157*c*, and/or 157*d* of one or more of the contacts 118. In such an embodiment wherein the spacing member body 181 covers and/or engages only a portion of the circumference of the outer surface 157 of one or more of the contacts 118, the spacing member body 181 may not hold one or more of the contacts 118, but rather may only space the contact(s) 118 apart by the predetermined pitch P. For example, in an alternative embodiment, the spacing member body 181 may include a plurality of fingers (not shown) that extend between each of the contacts 118, wherein the spacing member body 181 only engages and covers at least a portion of the side surfaces 157*b* and 157*d* (whether or not any portion of the spacing member body 181 covers a portion or all of any of the side surfaces 157*a* and/or 157*c*).

Figure 5:
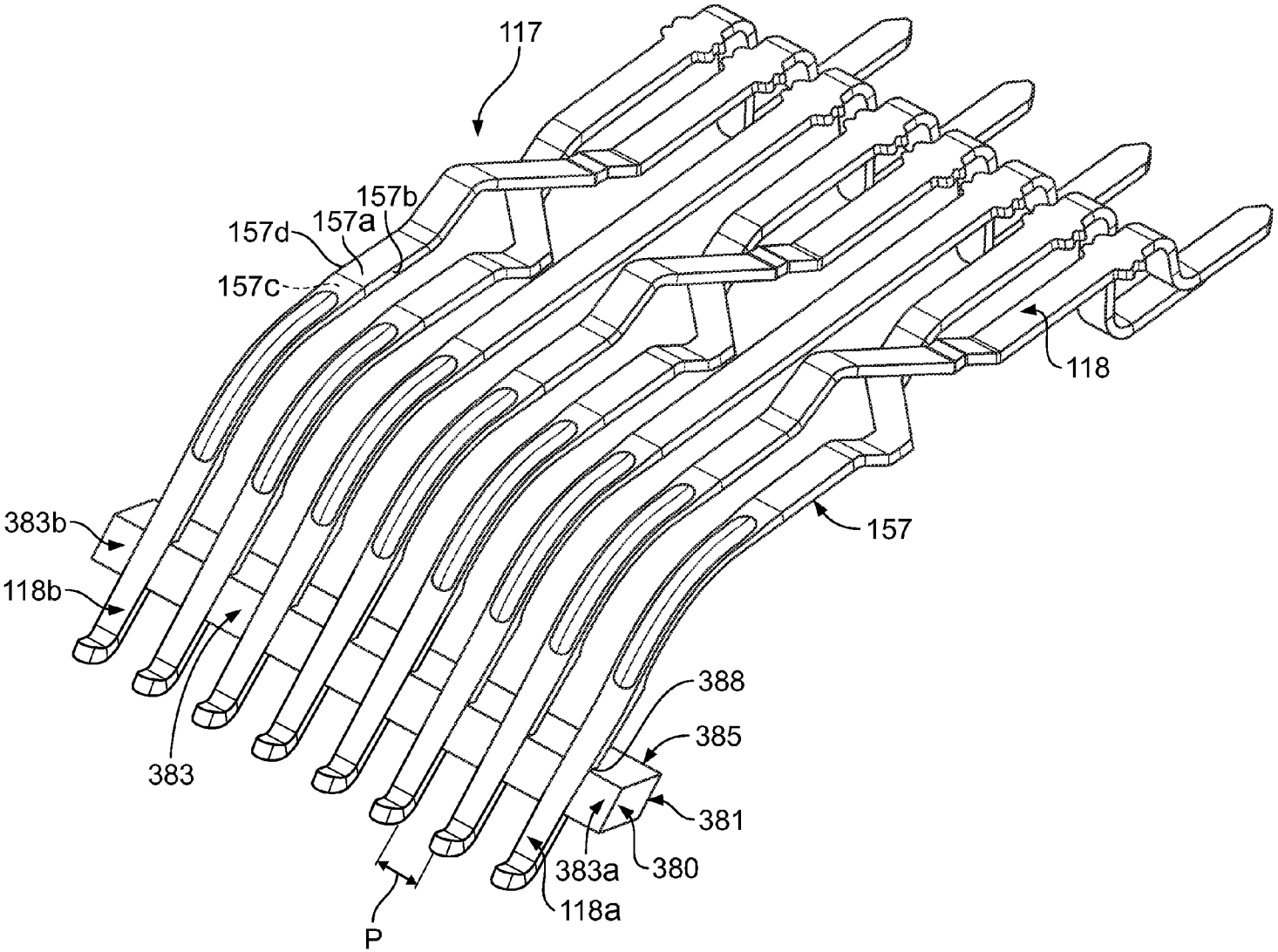
FIG. 5 is a perspective view of the contact array shown in FIG. 4 and an exemplary alternative embodiment of a spacing member.

FIG. 5 is a perspective view of the contact array 117 and an exemplary alternative embodiment of a spacing member 380. The spacing member 380 includes a body 381 that covers and engages the side surfaces 157*b*, 157*c*, and 157*d* of each contact 118. However, the body 381 of the spacing member 380 does not cover or engage the side surface 157*a* of each contact 118. Specifically, the body 381 of the spacing member 380 includes a plurality of fingers 383 that extend between adjacent contacts 118. The fingers 383 cover and engage the side surfaces 157*b* and 157*d*. A base 385 of the spacing member body 381 covers and engages the side surfaces 157*c* of each of the contacts 118. As can be seen in FIG. 5, each contact 118 is held within a corresponding opening 388 of the spacing member body 381 that is defined between adjacent fingers 383. Accordingly, in the exemplary embodiment shown in FIG. 5, the spacing member 380 both holds each of the contacts 118 and spaces adjacent contacts 118 apart by the predetermined pitch P. In an alternative embodiment, the spacing member body 381 does not include one or both of the outermost fingers 383*a* and 383*b* such that the spacing member body 381 does not engage or cover the side surface 157*b* of the contact 118*a* and/or does not engage or cover the side surface 157*d* of the contact 118*b*.

Referring again to FIG. 4, the spacing member body 181 engages each contact 118 at a location along the length of the contact 118 that is between the mating interface 120 and the tip surface 176. Specifically, in the exemplary embodiment, the spacing member body 181 engages each contact 118 along the leg 174 of the tip end portion 156. Moreover, in the exemplary embodiment, the portion X of the length of each contact 118 that the spacing member body 181 extends along is entirely between the mating interface 120 and the tip surface 176. In other words, in the exemplary embodiment, an entirety of the spacing member body 181 is located between the mating interface 120 and the tip surface 176. However, any portion of the spacing member body 181 may have any location relative to each of the contacts 118 so long as the spacing member body 181 engages each contact 118 at a location along the length of the contact 118 that is between the mating interface 120 and the tip surface 176. For example, one or more portions of the spacing member body 181 may extend along the contact axis 152 past the tip surface 176 in the direction of the arrow B of FIG. 4, and/or one or more portions of the spacing member body 181 may extend along the contact axis 152 past an intersection between the mating interface 120 and the leg 174 in the direction of the arrow C of FIG. 4. Moreover, and for example, one or more portions or an approximate entirety of the spacing member body 181 may extend along the tip 172 of one or more of the contacts 118.

In the exemplary embodiment, the body 181 of the spacing member 180 extends a length between a pair of opposite end portions 190 and 192. Each end portion 190 and 192 includes a respective side wall 194 and 196. As will be described below, in the exemplary embodiment, the side walls 194 and 196 are each optionally configured to engage a respective wall 198 and 200 (FIGS. 2 and 7) of the base 130 (FIGS. 1, 2, and 7) such that the tip end portions 156 of the contacts 118 can float relative to the base 130. In alternative embodiments, one or both of the side walls 194 and 196 include a latch feature (not shown) that cooperates with a latch member (not shown) on the base 130 to latch the spacing member 180 to the base 130. Moreover, in alternative embodiments, the side walls 194 and/or 196 may engage the base 130 with an interference fit.

The body 181 of the spacing member 180 may be formed from any suitable material(s) having dielectric properties, such as, but not limited to plastic and/or the like. Moreover, the spacing member body 181 may be formed using any process, method, means, and/or the like. In the exemplary embodiment, the body 181 is molded over the contact array 117 using any molding process. The body 181 is formed separately from the base 130. As used herein, things that are "formed separately" are not connected together during formation.

In the exemplary embodiment, the spacing member body 181 is a single, unitary structure. However, in alternative embodiments, the spacing member body 181 consists of two or more body portions that are formed separately from each other, or one integrally formed body portion that is separated into two or more body portions after formation. In embodiments wherein the spacing member body 181 consists of two or more bodies (whether formed separately or separated after integral formation), each body portion may be connected to one or more other body portions, may engage one or more body portions, and/or may not engage one or more other body portions. A body portion may connect to one or more other body portions using any structure, arrangement, method, process, means, configuration, and/or the like, such as, but not limited to, using an interference fit, one or more latch members and/or features, and/or the like.

Figure 6:
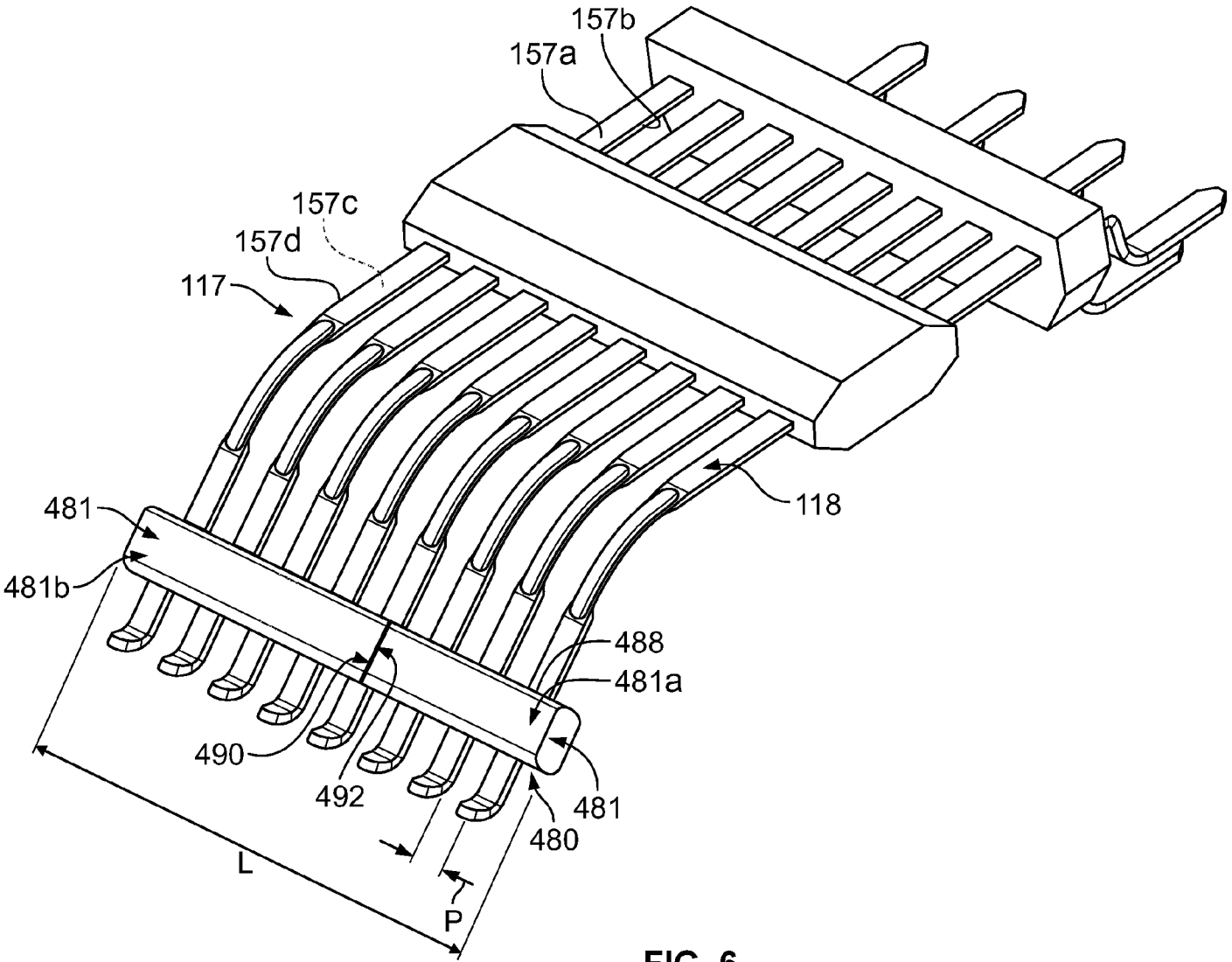
FIG. 6 is a front perspective view of the contact array shown in FIG. 4 and another exemplary alternative embodiment of a spacing member.

FIG. 6 is a perspective view of the contact array 117 and an exemplary alternative embodiment of a spacing member 480. The spacing member 480 includes a body 481 that covers and engages the side surfaces 157*a*, 157*b*, 157*c*, and 157*d* of each contact 118. Each contact 118 is held within a corresponding opening 488 of the spacing member body 481. Accordingly, in the exemplary embodiment shown in FIG. 6, the spacing member 480 both holds each of the contacts 118 and spaces adjacent contacts 118 apart by the predetermined pitch P. As can be seen in FIG. 6, the spacing member body 481 includes two body portions 481*a* and 481*b* that engage each other at opposing end portions 490 and 492 thereof. The body portions 481*a* and 481*b* are either formed separately from each other, or are formed as one integrally formed body 481 that is separated into the two body portions 481*a* and 481*b* after formation. Although two body portions 481*a* and 481*b* are shown, the spacing member body 481 may include any number of body portions. Moreover, the location of the end portions 490 and 492 along a length L of the spacing member body 481 are exemplary only. The end portions 490 and 492, and thus an interface between the body portions 481*a* and 481*b*, may be located at any location along the length L of the spacing member body 481, whether or not the end portions 490 and 492 engage other. In other words, each body portion 481*a* and 481*b* may define any portion of the overall length L of the spacing member body 481, whether or not there is a gap (not shown) between the body portions 481*a* and 481*b*.

Referring again to FIG. 4, the spacing member 182 is optional such that, in some embodiments, the contact subassembly 110 (FIGS. 1 and 2) does not include the spacing member 182. The spacing member 182 positions each contact 118 relative to each adjacent contact 118. For example, the spacing member 182 may facilitate spacing the mating interfaces 120 of the contacts 118 apart from each other by the predetermined pitch P. The spacing member 182 also facilitates preventing adjacent contacts 118 from engaging and thereby electrically shorting. The spacing member 182 may also facilitate orienting and/or aligning the contact array 117 with the base 130 and/or latching the contact array 117 to the base 130, as will be described below. The spacing member 182 may be referred to herein as a "second spacing member".

The spacing member 182 includes a body 187 that spaces apart the contacts 118 via engagement with each contact 118. In other words, the spacing member 182 positions each contact 118 relative to each adjacent contact 118. In the exemplary embodiment, the spacing member body 187 covers and engages an approximate entirety of a circumference of the outer surface 157 of each contact 118 (along a portion Y of the length of the contact 118). Specifically, the spacing member body 187 includes a plurality of openings 189. Each contact 118 extends through a corresponding one of the openings 189 and the surface(s) of the spacing member body 187 defining each opening 189 covers and engages an approximate entirety of the circumference of the outer surface 157 of the corresponding contact 118. Accordingly, in the exemplary embodiment, each contact 118 is held by the spacing member 182. Alternatively, the spacing member body 187 only covers and/or engages a portion of the circumference of the outer surface 157 of one or more of the contacts 118. For example, the spacing member body 187 may only cover and/or engage a portion or all of only some of the side surfaces 157*a*, 157*b*, 157*c*, and/or 157*d* of one or more of the contacts 118. In such an embodiment wherein the spacing member body 187 covers and/or engages only a portion of the circumference of the outer surface 157 of one or more of the contacts 118, the spacing member body 187 may not hold one or more of the contacts 118, but rather may only space the contact(s) 118 apart by the predetermined pitch P. For example, in an alternative embodiment, the spacing member body 187 may include a plurality of fingers (not shown) that extend between each of the contacts 118, wherein the spacing member body 187 only engages and covers at least a portion of the side surfaces 157*b* and 157*d* (whether or not any portion of the spacing member body 187 covers a portion or all of any of the side surfaces 157*a* and/or 157*c*).

The spacing member body 187 engages each contact 118 at a location along the length of the contact 118 that is between the mating interface 120 and the terminating surface 160. Specifically, in the exemplary embodiment, the spacing member body 187 engages each contact 118 along the intermediate portion 158 between the cross-over section 170 (if the corresponding contact includes a cross-over section 170; the cross-over section is visible in FIG. 3) and the bend 166 of the terminating end portion 154. Moreover, in the exemplary embodiment, the portion Y of the length of each contact 118 that the spacing member body 187 extends along is entirely between the bend 166 and the cross-over section 170. In other words, in the exemplary embodiment, an entirety of the spacing member body 187 is located between the cross-over section 170 and the bend 166. However, any portion of the spacing member body 187 may have any location relative to each of the contacts 118 so long as the spacing member body 187 engages each contact 118 at a location along the length of the contact 118 that is between the mating interface 120 and the terminating surface 160. For example, one or more portions of the spacing member body 181 may extend along the bend 166, the leg 162, the bend 168, the leg 164, and/or the cross-over section 170.

In the exemplary embodiment, the body 187 of the spacing member 182 extends a length between a pair of opposite end portions 202 and 204. Each end portion 202 and 204 includes a respective side wall 206 and 208. As will be described below, in the exemplary embodiment, the side walls 206 and 208 are each configured to engage a respective wall 210 and 212 (FIGS. 2 and 7) of the base 130. In the exemplary embodiment, each side wall 206 and 208 includes an optional latch feature 214 that, as will be described below, cooperates with a latch member 216 (FIG. 7) on the base 130 to latch the spacing member 182, and thus the contact array 117, to the base 130. In the exemplary embodiment, the latch feature 214 includes a shoulder 218. However, in addition or alternative to the shoulder 218, the latch feature 214 may include any other structure, means, and/or the like that enables the spacing member 182 to latch to base 130. Moreover, in addition or alternative to the latch feature 214, the spacing member 182 may latch to the base 130 using an interference fit.

The body 187 of the spacing member 182 may be formed from any suitable material(s) having dielectric properties, such as, but not limited to plastic and/or the like. Moreover, the spacing member body 187 may be formed using any process, method, means, and/or the like. In the exemplary embodiment, the body 187 is molded over the contact array 117 using any molding process. The body 187 is formed separately from the base 130. In the exemplary embodiment, the spacing member body 187 is a single, unitary structure. However, in alternative embodiments, the spacing member body 187 consists of two or more body portions that are formed separately from each other, or one integrally formed body portion that is separated into two or more body portions after formation. In embodiments wherein the spacing member body 187 consists of two or more bodies (whether formed separately or separated after formation), each body portion may be connected to one or more other body portions, may engage one or more body portions, and/or may not engage one or more other body portions. A body portion may connect to one or more other body portions using any structure, arrangement, method, process, means, configuration, and/or the like, such as, but not limited to, using an interference fit, one or more latch members and/or features, and/or the like.

Turning to the spacing member 184, the spacing member 184 is optional such that, in some embodiments, the contact sub-assembly 110 does not include the spacing member 184. The spacing member 184 positions each contact 118 relative to each adjacent contact 118. For example, the spacing member 184 may facilitate spacing the mating interfaces 120 of the contacts 118 apart from each other by the predetermined pitch P. The spacing member 184 also facilitates preventing adjacent contacts 118 from engaging and thereby electrically shorting. The spacing member 184 may be referred to herein as a "second spacing member".

The spacing member 184 includes a body 191 that spaces apart the contacts 118 via engagement with each contact 118. In other words, the spacing member 184 positions each contact 118 relative to each adjacent contact 118. In the exemplary embodiment, the spacing member body 191 covers and engages an approximate entirety of a circumference of the outer surface 157 of each contact 118 (along a portion Z of the length of the contact 118). Specifically, the spacing member body 191 includes a plurality of openings 193. Each contact 118 extends through a corresponding one of the openings 193 and the surface(s) of the spacing member body 191 defining each opening 193 covers and engages an approximate entirety of the circumference of the outer surface 157 of the corresponding contact 118. Accordingly, in the exemplary embodiment, each contact 118 is held by the spacing member 184. Alternatively, the spacing member body 191 only covers and/or engages a portion of the circumference of the outer surface 157 of one or more of the contacts 118. For example, the spacing member body 191 may only cover and/or engage a portion or all of only some of the side surfaces 157*a*, 157*b*, 157*c*, and/or 157*d* of one or more of the contacts 118. In such an embodiment wherein the spacing member body 191 covers and/or engages only a portion of the circumference of the outer surface 157 of one or more of the contacts 118, the spacing member body 191 may not hold one or more of the contacts 118, but rather may only space the contact(s) 118 apart by the predetermined pitch P. For example, in an alternative embodiment, the spacing member body 191 may include a plurality of fingers (not shown) that extend between each of the contacts 118, wherein the spacing member body 191 only engages and covers at least a portion of the side surfaces 157*b* and 157*d* (whether or not any portion of the spacing member body 191 covers a portion or all of any of the side surfaces 157*a* and/or 157*c*).

The spacing member body 191 engages each contact 118 at a location along the length of the contact 118 that is along the intermediate portion 158. Specifically, in the exemplary embodiment, the spacing member body 191 engages each contact 118 at the cross-over section 170 (if the corresponding contact includes a cross-over section 170). In addition or alternative to engaging each contact 118 adjacent the cross-over section 170, the spacing member body 191 may engage each contact 118 at, and/or extend along, any other location along the intermediate portion 158. In the exemplary embodiment, the portion Z of the length of each contact 118 that the spacing member body 191 extends along is entirely along the intermediate portion 158. In other words, an entirety of the spacing member body 191 is located along the intermediate portion 158.

In the exemplary embodiment, the body 191 of the spacing member 184 extends a length between a pair of opposite end portions 220 and 222. Each end portion 220 and 222 includes a respective side wall 224 and 226. The side walls 224 and 226 optionally engage a corresponding wall of the housing 102 (FIG. 1). One or both of the side walls 224 and 226 optionally include a latch feature (not shown) that cooperates with a latch member (not shown) on the corresponding housing wall to latch the spacing member 184 to the housing 102. Moreover, the side walls 224 and 226 optionally engage the corresponding housing wall with an interference fit.

The body 191 of the spacing member 184 may be formed from any suitable material(s) having dielectric properties, such as, but not limited to plastic, acrylic, epoxy, resin, and/or the like. Moreover, the spacing member body 191 may be formed using any process, method, means, structure, and/or the like, such as, but not limited to, molding, extrusion, a solidification and/or curing process, and/or the like. In some embodiments wherein the body 191 is not formed around the contact array 117, the body 191 may be attached to the array using any suitable process, method, structure, means, and/or the like, such as, but not limited to, using an adhesive, bonding the body 191 to the contact array 117, using a tape, and/or the like. In the exemplary embodiment, the body 191 is molded over the contact array 117 using any molding process, such as, but not limited to, over-molding, injection molding, and/or the like. The body 191 is formed separately from the base 130.

In the exemplary embodiment, the spacing member body 191 is a single, unitary structure. However, in alternative embodiments, the spacing member body 191 consists of two or more body portions that are formed separately from each other, or one integrally formed body portion that is separated into two or more body portions after formation. In embodiments wherein the spacing member body 191 consists of two or more bodies (whether formed separately or separated after formation), each body portion may be connected to one or more other body portions, may engage one or more body portions, and/or may not engage one or more other body portions. A body portion may connect to one or more other body portions using any structure, arrangement, method, process, means, configuration, and/or the like, such as, but not limited to, using an interference fit, one or more latch members and/or features, and/or the like.

Figure 7:
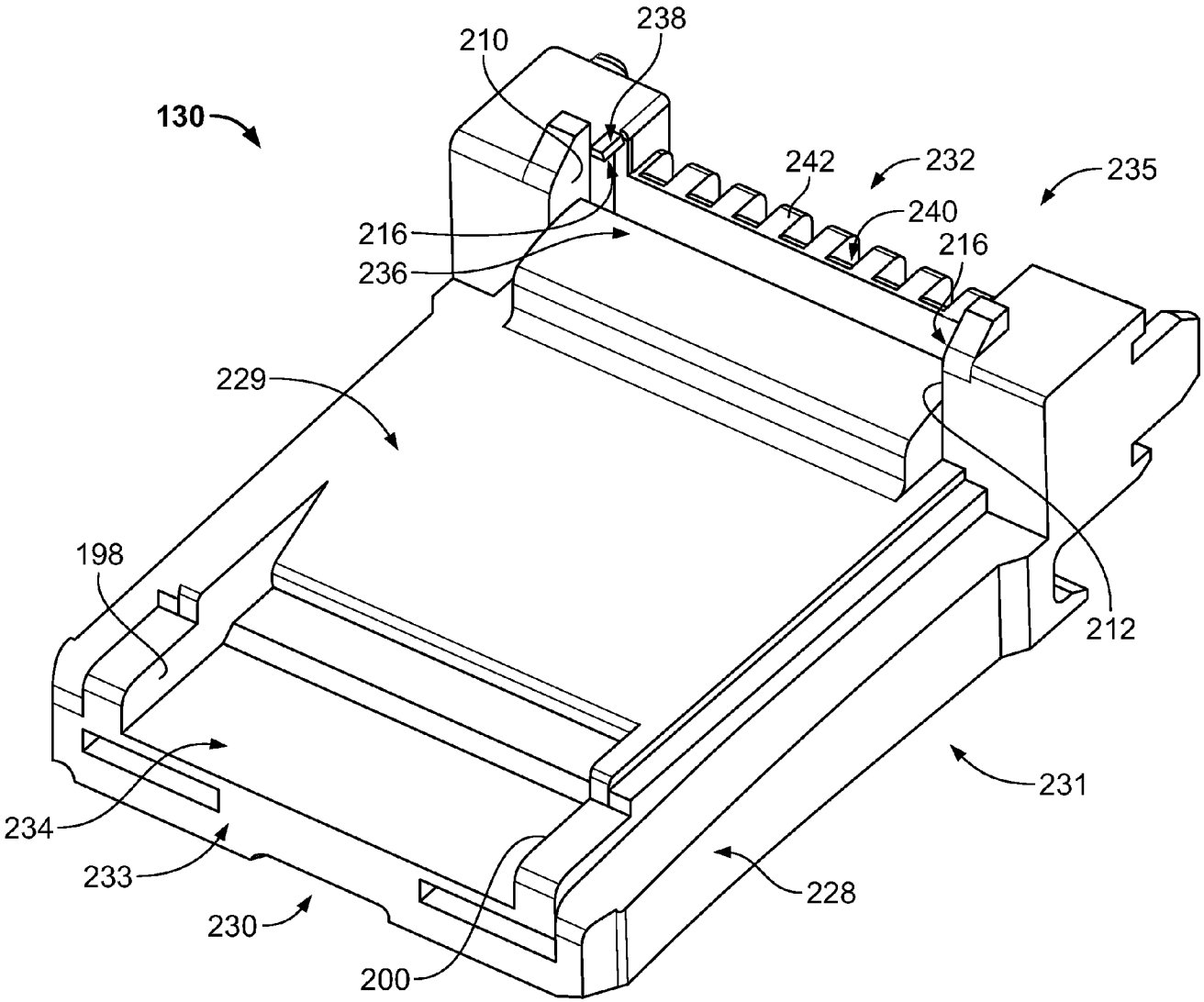
FIG. 7 is a rear perspective view of an exemplary embodiment of a base of the contact sub-assembly shown in FIG. 2.

FIG. 7 is a perspective view of an exemplary embodiment of the base 130. The base 130 includes a body 228 extending a length from a mating end portion 230 to a terminating end portion 232. The body 228 includes a contact array side 229 and an opposite side 231. An opposite pair of sides 233 and 235 defined at the mating end portion 230 and the terminating end portion 232, respectively, extend between the contact array side 229 and the side 231. When mounted on the base 130, the contact array 117 (FIGS. 1-4) extends along contact array side 229. The contact array side 229 includes a recess 234 at the mating end portion 230 that receives at least a portion of the spacing member 180 (FIGS. 2 and 4) and at least a portion of the tip end portions 156 (FIGS. 2-4) of the contacts 118 (FIGS. 1-4) therein. The recess 234 is partially defined by the walls 198 and 200, which oppose each other. As will be described below, in the exemplary embodiment, walls 198 and 200 engage the side walls 194 and 196 (FIGS. 2 and 4), respectively, of the spacing member 180 when the contact array 117 is mounted on the base 130.

At the terminating end portion 232, the contact array side 229 includes a recess 236 that receives the spacing member 182 (FIGS. 2 and 4) and a portion of each of the intermediate portions 158 (FIGS. 3 and 4) of the contacts 118 therein. The recess 236 is partially defined by the walls 210 and 212, which oppose each other. In the exemplary embodiment, the walls 210 and 212 engage the side walls 206 and 208 (FIGS. 2 and 4), respectively, of the spacing member 182 when the contact array 117 is mounted on the base 130, as will be described below. In the exemplary embodiment, each wall 210 and 212 includes one of the latch members 216 (only one of which is visible in FIG. 7). In the exemplary embodiment, the latch members 216 each include an extension 238 (only one of which is visible in FIG. 7). However, in addition or alternative to the extension 238, the latch members 216 may each include any other structure, means, and/or the like that enables the spacing member 182 to latch to base 130. Moreover, in addition or alternative to the latch member 216, the spacing member 182 may latch to the base 130 using an interference fit.

A plurality of slots 240 are formed within the body 228 of the base 130 at the terminating end portion 232. Specifically, the slots 240 extend within the side 235 of the body 228. A length of each of the slots 240 extends approximately perpendicular to the length that the body 228 extends between the mating end portion 230 and the terminating end portion 232. The slots 240 are defined by a plurality of extensions 242 that extend outwardly at the terminating end portion 232 of the body 228. As will be described below, each slot 240 receives a portion of the terminating end portion 154 of a corresponding one of the contacts 118 therein. Specifically, each slot 240 receives the leg 162 (FIGS. 3 and 4) of a corresponding one of the contacts 118 therein. The slots 240 thereby facilitate aligning the terminating end portions 154 of the contacts 118 with the circuit board 132 (FIG. 2).

As described above, in some alternative embodiments, the terminating end portion 154 of one or more of the contacts 118 includes a single leg that extends from the intermediate portion 158 approximately parallel to the contact axis 152 (FIGS. 3 and 4). For example, in some alternative embodiments, the terminating end portion 154 of one or more of the contacts 118 does not include the bends 166 and 168 (FIGS. 3 and 4). In such embodiments wherein the terminating end portion 154 of one or more of the contacts 118 includes a single leg that extends from the intermediate portion 158 approximately parallel to the contact axis 152 and/or does not include the bends 166 and 168, one or more of the slots 240 may not be included in the body 228.

Referring again to FIG. 2, the contact array 117 is mounted on the base 130 such that the spacing members 180 and 182 are received within the respective recess 234 and 236 of the base 130. The tip end portions 156 of the contacts 118 are also received within the recess 234. Although not visible in FIG. 2, the leg 162 (FIGS. 3 and 4) of the terminating end portion 154 of each contact 118 extends within the corresponding slot 240 of the base 130. Each shoulder 218 of the spacing member 182 is engaged with the corresponding extension 238 of the base 130 to latch the contact array 117 to the base 130.

During mounting of the contact array 117 on the base 130, the spacing members 180, 182, and 184 each facilitate spacing the mating interface 120 of each contact 118 apart from the mating interfaces 120 of each adjacent contact 118 by the predetermined pitch P. The spacing members 180 and 182 may also facilitate orienting and/or aligning the contact array 117 with respect to the base 130 via engagement with the walls 198 and 200 and 210 and 212, respectively, of the base 130. The spacing member 184 may also facilitate orienting and/or aligning the contact array with respect to the base 130 via engagement with one or more walls of the housing 102. (FIG. 1).

As described above, in the exemplary embodiment, the tip end portions 156 of the contacts 118 optionally float relative to the base 130. Specifically, engagement between the side walls 194 and 196 of the spacing member 180 and the respective walls 198 and 200 of the base 130 is such that enables the contacts 118 to slide within the recess 234 relative to the base 130. For example, during mating with the mating plug, the contacts 118 may be depressed toward the base 130 to provide clearance for the mating connector within the cavity 108 (FIG. 1). As the contacts 118 are depressed, the tip end portions 156 of the contacts 118 are moved generally in the direction of the arrow D. In an alternative embodiment, the tip end portion 156 of one or more of the contacts 118 may be connected to a circuit board (not shown) located within and/or adjacent the recess 234 of the base 130.

The embodiments described and/or illustrated herein provide an electrical connector having a contact sub-assembly and/or a base that is easier and/or less expensive to manufacture and/or assemble than the contact sub-assembly of at least some known electrical connectors. For example, the embodiments described and/or illustrated herein may enable the reduction and/or elimination of an entirety or a portion of one or more slots on the contact array side of the base of the contact sub-assembly. The embodiments described and/or illustrated herein may provide an electrical connector having an improved electrical performance, such as, but not limited to, improved impedance, return loss, cross talk, insulation resistance, dielectric withstand, dielectric breakdown, and/or the like.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A contact sub-assembly for an electrical connector, said contact sub-assembly comprising:

a base;

an array of contacts held by the base, each contact extending along a length from a terminating end portion to a tip end portion, the terminating end portion being configured to be at least one of terminated to a circuit board or terminated to a wire, the tip end portion comprising a tip surface, each contact having a mating interface located along the length of the contact between the terminating end portion and the tip end portion; and a spacing member formed separately from the base, the spacing member engaging each of the contacts such that each contact is positioned relative to adjacent contact in the array, wherein at least a portion of the spacing member engages each contact at a location along the length of the contact that is between the mating interface and the tip surface.

2. The contact sub-assembly according to claim 1, wherein the spacing member covers a portion of each of the contacts.

3. The contact sub-assembly according to claim 1, wherein each contact is held by the spacing member.

4. The contact sub-assembly according to claim 1, wherein the spacing member is molded over a portion of at least one of the contacts.

5. The contact sub-assembly according to claim 1, wherein each contact comprises an outer surface extending along the length from the terminating end portion to the tip end portion, the spacing member covering an approximate entirety of a circumference of the outer surface of each of the contacts along a portion of the length thereof.

6. The contact sub-assembly according to claim 1, wherein the spacing member comprises an opening extending through the spacing member, one of the contacts extending through the opening.

7. The contact sub-assembly according to claim 1, wherein the spacing member extends along the length of each contact entirely between the mating interface and the tip surface.

8. The contact sub-assembly according to claim 1, wherein the tip end portion of each contact comprises a tip that includes the tip surface, and wherein the spacing member does not engage the tip of at least one of the contacts.

9. The contact sub-assembly according to claim 1, wherein the spacing member is a first spacing member, the contact sub-assembly further comprising a second spacing member formed separately from the base, wherein at least a portion of the second spacing member engages each contact at a location along the length of the contact that is between the mating interface and a terminating surface of the terminating end portion.

10. The contact sub-assembly according to claim 9, wherein the second spacing member comprises a latch feature that cooperates with a latch member of the base to connect the second spacing member to the base.

11. The contact sub-assembly according to claim 1, wherein the spacing member is a first spacing member, at least one of the contacts comprising a cross-over section, the contact sub-assembly further comprising a second spacing member formed separately from the base, wherein at least a portion of the second spacing member engages the at least one contact at a location along the length of the at least one contact that is between the cross-over section and a terminating surface of the terminating end portion.

12. An electrical connector comprising:

a housing; and a contact sub-assembly held by the housing, the contact sub-assembly comprising:

a base;

an array of contacts held by the base, each contact extending along a length from a terminating end portion to a tip end portion, the terminating end portion being configured to be at least one of terminated to a circuit board or terminated to a wire, the tip end portion comprising a tip surface, each contact having a mating interface located along the length of the contact between the terminating end portion and the tip end portion; and a spacing member formed separately from the base, the spacing member engaging each of the contacts such that each contact is positioned relative to each adjacent contact in the array, wherein at least a portion of the spacing member engages each contact at a location along the length of the contact that is between the mating interface and the tip surface.

13. The electrical connector according to claim 12, wherein each contact is held by the spacing member.

14. The electrical connector according to claim 12, wherein the spacing member is molded over a portion of at least one of the contacts.

15. The electrical connector according to claim 12, wherein the spacing member comprises an opening extending through the spacing member, one of the contacts extending through the opening.

16. The electrical connector according to claim 12, wherein the spacing member extends along the length of each contact entirely between the mating interface and the tip surface.

17. The electrical connector according to claim 12, wherein the spacing member comprises one of:

two separately formed bodies; and one integrally formed body separated into two separate bodies.

18. The electrical connector according to claim 12, wherein the spacing member is a first spacing member, at least one of the contacts comprising a cross-over section, the contact sub-assembly further comprising a second spacing member formed separately from the base, wherein at least a portion of the second spacing member engages the at least one contact at a location along the length of the at least one contact that is between the cross-over section and a terminating surface of the terminating end portion.

19. The electrical connector according to claim 12, wherein the tip end portion of each contact comprises a tip that includes the tip surface, and wherein the spacing member does not engage the tip of at least one of the contacts.

20. A contact sub-assembly for an electrical connector, said contact sub-assembly comprising:

a base;

an array of contacts held by the base, each contact extending along a length from a terminating end portion to a tip end portion, the terminating end portion being configured to be at least one of terminated to a circuit board or terminated to a wire, the tip end portion comprising a tip surface, each contact having a mating interface located along the length of the contact between the terminating end portion and the tip end portion; and a spacing member molded over a portion of at least one of the contacts, the spacing member engaging each of the contacts such that each contact is positioned relative to each adjacent contact in the array, wherein at least a portion of the spacing member engages each contact at a location along the length of the contact that is between the mating interface and the tip surface.

21. The contact sub-assembly according to claim 20, wherein the tip end portion of each contact comprises a tip that includes the tip surface, and wherein the spacing member does not engage the tip of at least one of the contacts.

* * * * *